US006795052B2

(12) United States Patent
Lin et al.

(10) Patent No.: US 6,795,052 B2
(45) Date of Patent: Sep. 21, 2004

(54) VOLTAGE REFERENCE WITH CONTROLLABLE TEMPERATURE COEFFICIENTS

(75) Inventors: Jizoo Lin, Hsinchu (TW); Jong-Ping Lee, Hsinchu (TW); Yung-Peng Hwang, Taipei (TW)

(73) Assignee: Winbond Electronics Corp., Hsinchu (TW)

( * ) Notice: Subject to any disclaimer, the term of this patent is extended or adjusted under 35 U.S.C. 154(b) by 141 days.

(21) Appl. No.: 09/885,207

(22) Filed: Jun. 20, 2001

(65) Prior Publication Data

US 2002/0105494 A1 Aug. 8, 2002

(30) Foreign Application Priority Data

Feb. 6, 2001 (TW) ..... 90102473 A

(51) Int. Cl.[7] ..... G09G 3/36
(52) U.S. Cl. ..... 345/101; 323/313; 345/87
(58) Field of Search ..... 345/101, 87; 323/313

(56) References Cited

U.S. PATENT DOCUMENTS

| | | | | | |
|---|---|---|---|---|---|
| 4,114,085 | A | * | 9/1978 | Leinonen et al. | 323/280 |
| 4,352,056 | A | * | 9/1982 | Cave et al. | 323/314 |
| 4,604,568 | A | * | 8/1986 | Prieto | 323/315 |
| 5,936,603 | A | * | 8/1999 | Lippmann et al. | 345/101 |
| 6,111,397 | A | * | 8/2000 | Leung | 323/315 |
| 6,384,586 | B1 | * | 5/2002 | Sugawara | 323/313 |

* cited by examiner

*Primary Examiner*—Dennis-Doon Chow
*Assistant Examiner*—Ming-Hun Liu
(74) *Attorney, Agent, or Firm*—Ladas & Parry

(57) ABSTRACT

A voltage reference circuit and method for producing a voltage as a reference voltage for a liquid crystal display (LCD) panel. The voltage reference circuit with controllable temperature coefficients includes a logic operation unit and a voltage selection circuit. The logic operation unit receives a command corresponding to the temperature coefficient of an LCD panel and provides a selection signal according to the command. The selection signal is applied to the voltage selection circuit. Depending on the selection signal, the voltage selection circuit generates a selected voltage which is used to produce a reference voltage.

7 Claims, 5 Drawing Sheets

VOLTAGE REFERENCE WITH CONTROLLABLE TEMPERATURE COEFFICIENTS

BACKGROUND OF THE INVENTION

1. Field of the Invention

The present invention relates to a circuit and method for providing reference voltages, and more particularly to a circuit and method for providing reference voltages with controllable temperature coefficients. The voltage circuit provides a solution to the reference voltage requirements of liquid crystal display (LCD) drivers.

2. Description of the Prior Art

At present, a typical circuit for driving an LCD panel is known to include an LCD driver and an LCD voltage circuit. The LCD voltage circuit provides a reference voltage to the LCD driver for generating an LCD-driving voltage. However, the reference voltage changes according to temperature variation in order to compensate for the temperature effect of the LCD panel. The following equation describes the reference voltage $V_f$ at temperature t, $$V_f=V_d+g_f\times(t-T)=V_d+g_f\times\Delta T \quad (1)$$

wherein $V_d$ is the reference voltage $V_f$ at temperature T, $g_f$ is the temperature coefficient of $V_f$, and $\Delta T$ is the temperature difference of the LCD panel. Ideally, $V_d$ is independent of $g_f$. Different LCD panels have different respective temperature coefficients, whereby the temperature coefficient $g_f$ of the reference voltage $V_f$ changes in order to compensate for the temperature effect of the LCD panel.

FIG. 1 shows a common voltage reference in the form of a bandgap reference. Bandgap voltage reference sources are in themselves known. The reference voltage $V_f$ is equal to $V_{BE}+\alpha V_T \ln(m)$, where $V_{BE}$ is the base-to-emitter voltage of transistor $Q_1$, In is natural logarithm, m is the ratio of emitter areas of transistors $Q_1$ and $Q_2$, and $V_T$ is kq/T (k is Boltzmann's constant, q is electron charge, and T is absolute temperature). The parameter "$\alpha$" (the multiplier for the resistor R) represents the weighting of the temperature-dependent portion of the $V_f$. The output of bandgap reference $V_f$ is applied to the LCD driver. From equation (1), $V_f$ is also expressed as $$V_f=V_{BE}+\alpha V_T \ln(m)=V_d(g_f)+g_f\times\Delta T \quad (2)$$

wherein $V_d(g_f)$ is the reference voltage $V_f$ at temperature T and $V_d$ depends on the temperature coefficient $g_f$. According to equation (2), the bandgap voltage reference source can thus be tuned to get a different temperature coefficient $g_f$ by adjusting the parameter $\alpha$; therefore, the temperature effects of different LCD panels are compensated for slightly by adjusting the resistor value $\alpha R$. However, when the temperature coefficient $g_f$ changes $V_d(g_f)$ is also changed, that is, there is a drift of the reference voltage $V_f$ at temperature T. If the drift voltage is too large to match the LCD-driving voltage requirements of the LCD panel, the voltage reference circuit will not be compatible, and thus should be totally redesigned. In other words, an LCD panel design company has to implement a new application circuit and software if it designs with a new voltage reference circuit. Doing so will, of course, increase production costs and affect timely market launch.

Accordingly, there is a need for a circuit that can generate different reference voltages with controllable temperature coefficients and a DC voltage $V_d$ of the reference voltages that is independent of the temperature coefficients.

SUMMARY OF THE INVENTION

It is one object of the present invention to provide a voltage reference circuit with controllable temperature coefficients.

It is another object of the present invention to provide such a voltage reference circuit which can be used with LCD panels.

It is yet another object of the present invention to provide a voltage reference method for generating a reference voltage which has a temperature-independent DC voltage.

The foregoing objects are achieved in a circuit which provides a voltage reference source with controllable temperature coefficients. The voltage reference circuit comprises a logic operation unit and a voltage selection circuit. The logic operation unit receives a command corresponding to a temperature coefficient of an LCD panel and provides a selection signal according to the command. The voltage selection circuit then receives the selection signal and generates a selected voltage, wherein the selected voltage comprises a first DC voltage and the temperature coefficient. The voltage reference circuit further comprises a voltage regulation circuit controlled by the logic operation unit to regulate at a second DC voltage from the first DC voltage. Thus, the voltage reference circuit finally generates a reference voltage having the second DC voltage which is independent of the temperature coefficient.

There is provided a reference voltage producing method, which comprises the steps of: providing a plurality of selectable voltages which include respective temperature coefficients, selecting one of the plurality of selectable voltages as a selected voltage, and then producing the reference voltage corresponding to the selected voltage. The producing step comprises the steps of: selecting a amplification gain, and amplifying the selected voltage with the amplification gain to produce the reference voltage.

BRIEF DESCRIPTION OF THE DRAWINGS

The present invention will become more fully understood from the detailed description given hereinbelow and the accompanying drawings, given by way of illustration only and thus not intended to be limitative of the present invention.

DETAILED DESCRIPTION OF THE PREFERRED EMBODIMENT

Figure 1:
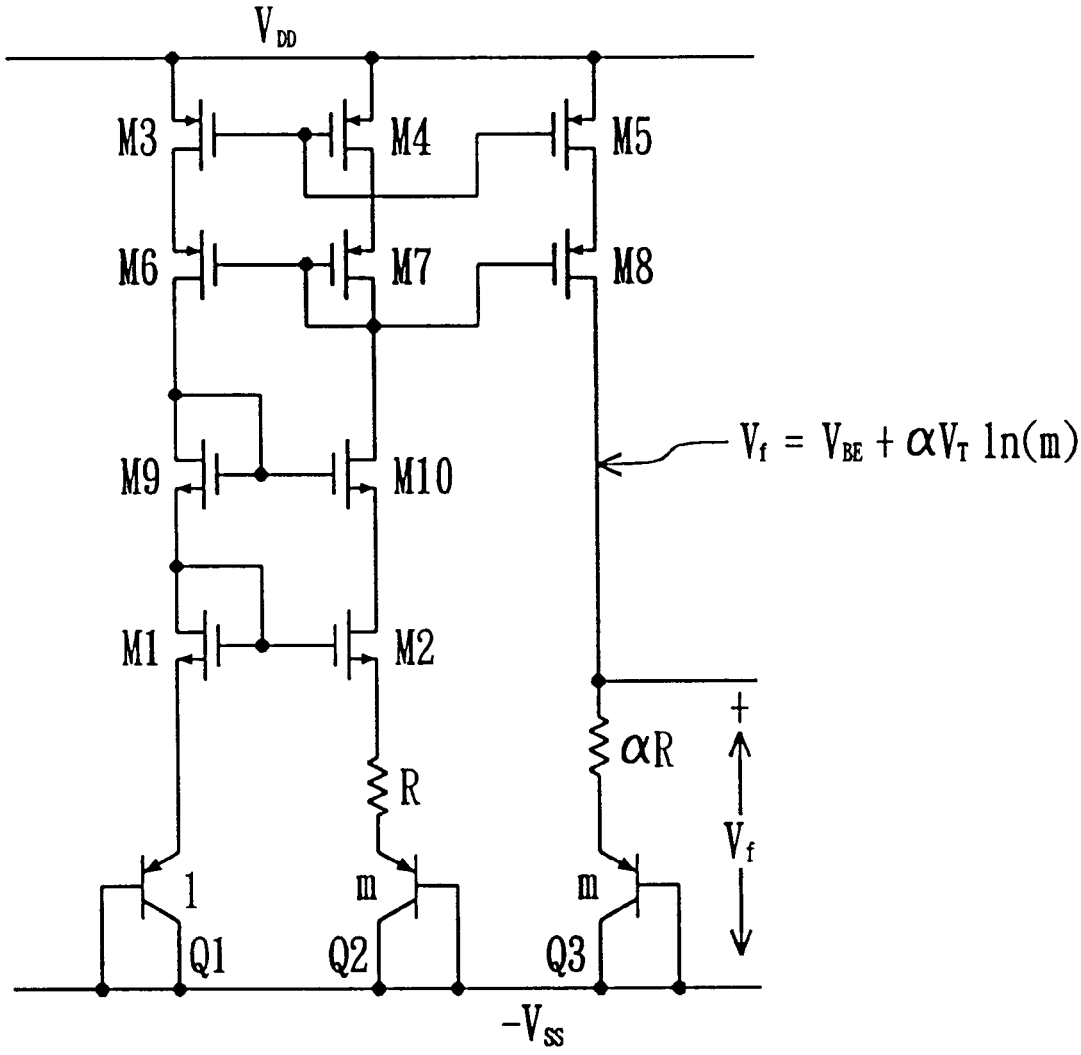
FIG. 1 (PRIOR ART)
FIG. 1 is a schematic diagram of a prior art bandgap reference circuit.
Figure 2:
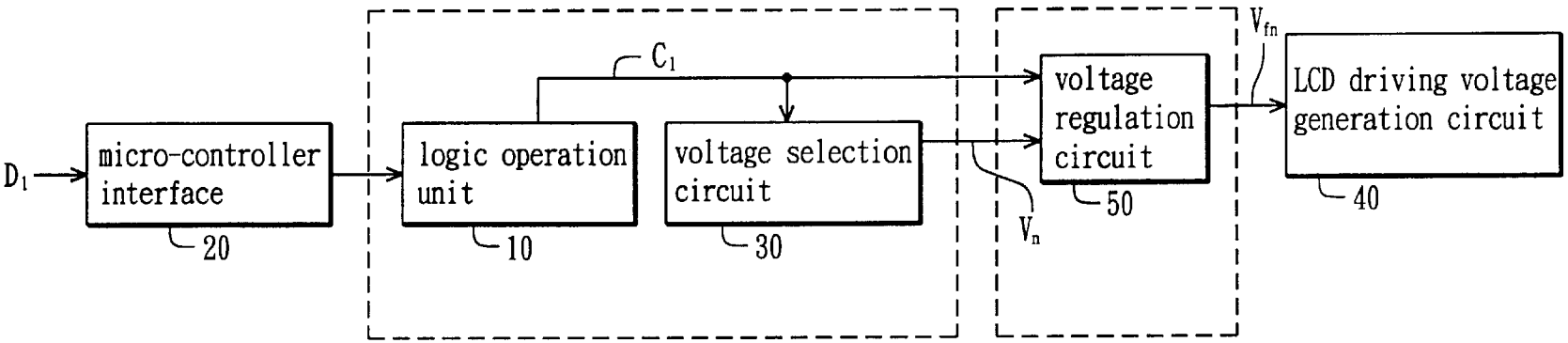
FIG. 2 is a diagram illustrating a voltage reference circuit with controllable temperature coefficients according to the invention.

In the preferred embodiment shown in FIG. 2, a voltage reference circuit with controllable temperature coefficients includes a logic operation unit 10 and a voltage selection circuit 30. The voltage reference circuit further includes a voltage regulation circuit 50. A selection signal C1 from the logic operation unit 10 is input to the voltage selection circuit 30 and the voltage regulation circuit 50. A selected voltage $V_n$ from the voltage selection circuit 30 is applied to the voltage regulation circuit 50. When an LCD panel's temperature coefficient is changed, using a new LCD panel for example, a micro-controller interface 20 outputs a command D1 to the logic operation unit 10, then the logic operation unit 10 outputs the selection signal C1 that corresponds to the temperature coefficient. After receiving the selection signal C1, the voltage selection circuit 30 provides the selected voltage $V_n$ to the voltage regulation circuit 50, and at the same time, the voltage regulation circuit 50 simultaneously receives the selection signal C1. The selected voltage $V_n$ is amplified and regulated by the voltage regulation circuit 50 to generate a reference voltage $V_{fn}$ Finally, the reference voltage $V_{fn}$ is input to an LCD driving voltage generation circuit 40 to generate an LCD-driving voltage.

Figure 3A:
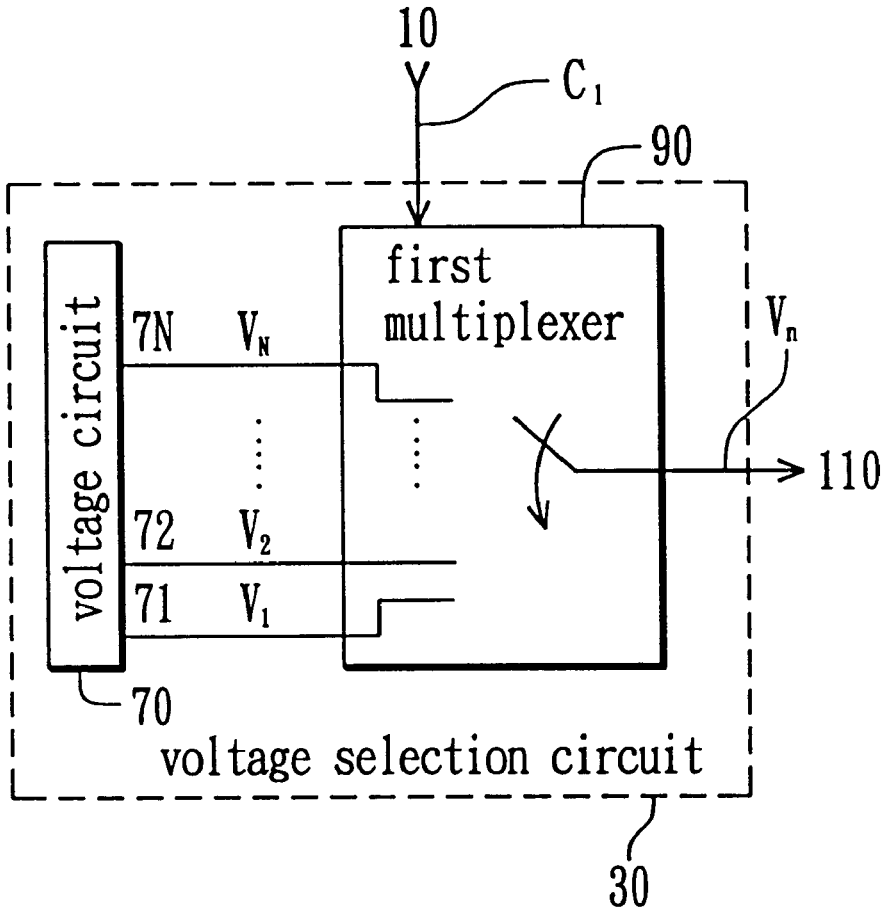
FIG. 3A is a diagram illustrating a voltage selection circuit according to FIG. 2.
Figure 3B:
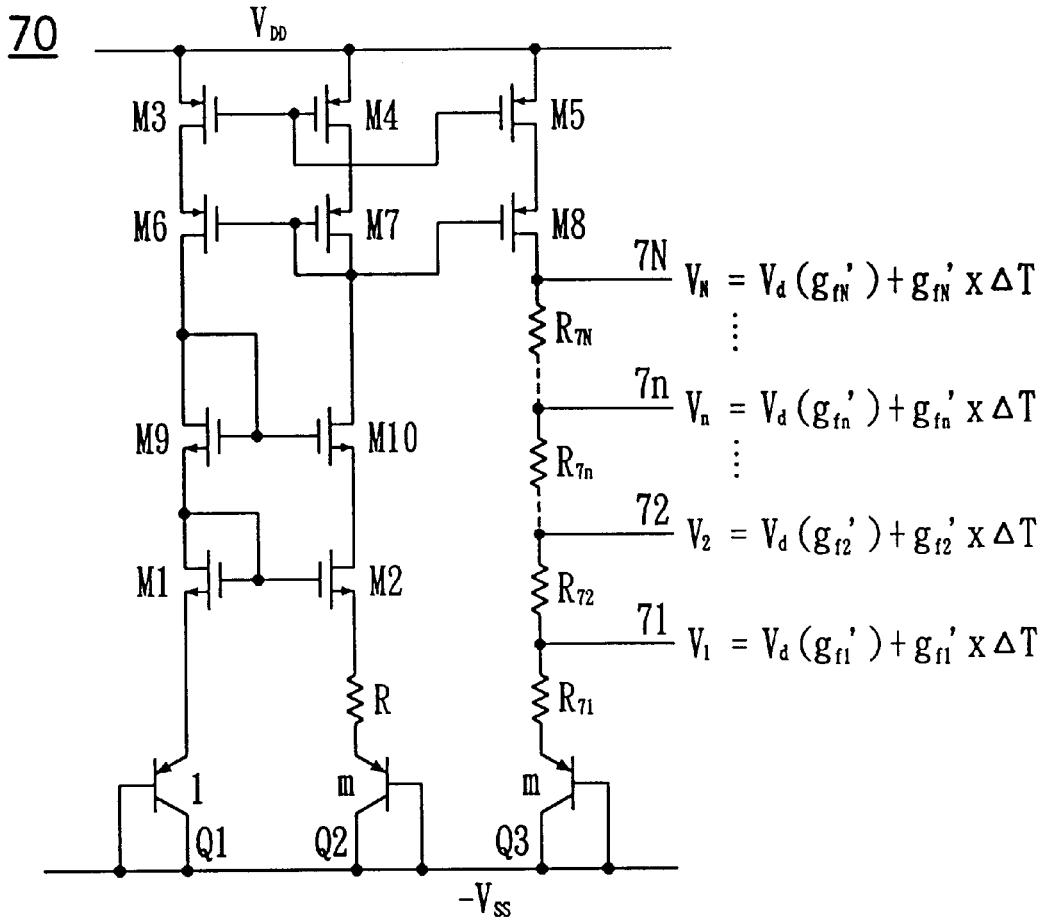
FIG. 3B is a schematic diagram of a voltage circuit having a plurality of outputs, provided in the diagram shown in FIG. 3A.

Referring to FIG. 3A, the voltage selection circuit 30 includes a voltage circuit 70 and a first multiplexer 90. The voltage circuit 70 has a plurality of output terminals 71~7N to provide a plurality of selectable voltages $V_1$~$V_N$. FIG. 3B illustrates a schematic diagram of the voltage circuit 70 utilized in the present invention. There are a plurality of resistors $R_{71}$~$R_{7N}$ connected in series and forming a plurality of output terminals 71~7N among the plurality of resistors $R_{71}$~$R_{7N}$. The plurality of selectable voltages $V_1$~$V_N$ at the respective output terminals 71~7N have respective temperature coefficients. The first multiplexer 90 selects one of the plurality of selectable voltage $V_1$~$V_N$ as the selected voltage $V_N$ in accordance with the selection signal C1 corresponding to the temperature coefficient $g_{fn}$ of the LCD panel. The selected voltage $V_n$ is given by the equation $$V_n=V_d(g_{fn}')+g_{fn}'\times\Delta T, n=1\sim N \quad (3)$$

wherein $V_d(g_{fn}')$ (hereinafter called the first DC voltage) is the selected voltage $V_n$ at temperature T and depending on the temperature coefficient $g_{fn}'$, $g_{fn}'$ is the temperature coefficient of $V_n$, and $\Delta T$ is the temperature difference of the LCD panel. The temperature coefficient $g_{fn}'$ is equal to $g_{fn}/A_n$ where $A_n$ is an amplification gain. The amplification gain $A_n$ will be described in detail later.

Figure 4:
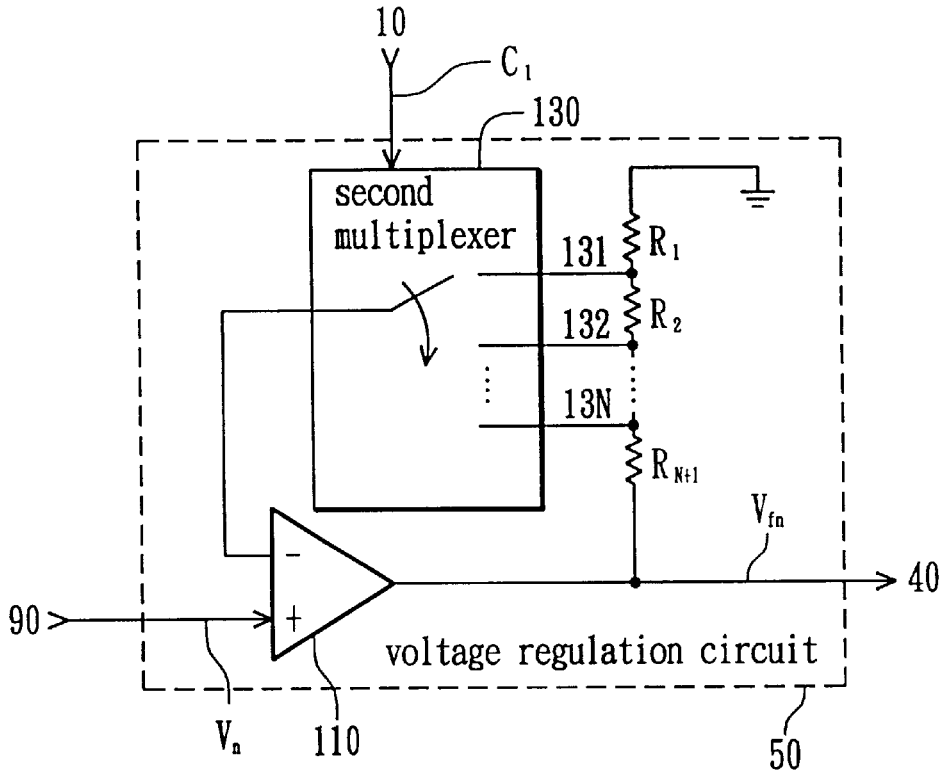
FIG. 4 is a diagram illustrating a voltage regulation circuit according to FIG. 2.

Although the selected voltage has a temperature coefficient controlled by the command D1, the first DC voltage is also changed when the temperature coefficient is changed. To solve the above problem simultaneously, the voltage reference circuit further includes the voltage regulation circuit 50 proposed by the present invention. Referring to FIG. 4, the voltage regulation circuit 50 includes an operational amplifier 110 and a second multiplexer 130. A plurality of resistors $R_1$~$R_{N+1}$ are connected in series between ground and an output terminal 111 of the operational amplifier 110, and forming a plurality of connection nodes 131–13N among the plurality of resistors $R_1$~$R_{N+1}$, wherein the plurality of resistors $R_1$~$R_{N+1}$ have the same temperature coefficient. An output terminal 91 of the first multiplexer 90 is connected to a non-inverting input terminal+of the operational amplifier 110. The second multiplexer 130 is controlled by the logic operation unit 10 to select one of the plurality of connection nodes 131~13N coupled to an inverting input terminal–of the operational amplifier 110. When the operational amplifier 110 receives the selected voltage $V_n$ from the voltage selection circuit 30, the second multiplexer 90 simultaneously selects one of the plurality of connection nodes 131~13N in accordance with the selection signal C1. A negative feedback amplifier is constructed using the operational amplifier 110, a selected node selected from the connection nodes 131~13N and the related resistors. Hence, the reference voltage $V_{fn}$ is given by:

$$\begin{aligned} V_{fn}&=V_n\times A_n \\ &=[V_d(g_{fn}')+g_{fn}'\times\Delta T]\times A_n \\ &=V_d(g_{fn}')\times A_n+g_{fn}\times\Delta T, n=1\sim N \end{aligned} \quad (4)$$

where $A_n=R_T/(R_1+\ldots+R_n)$ and $R_T=R_1+\ldots+R_{N+1}$. The value of $V_d(g_{fn}')\times A_n$ is designed to be a constant value $V_{dd}$. That is, $V_d(g_{f1}')\times A_1=\ldots=V_d(g_{fn}')\times A_n=\ldots=V_d(g_{fn}')\times A_N=$ Vdd, at temperature T. The equation (4) becomes $$V_{fn}=V_{dd}+g_{fn}\times\Delta T, n=1N \quad (5)$$

The equation (5) features a second DC voltage $V_{dd}$ which is independent of the temperature coefficient $g_{fn}$. Therefore, if the temperature coefficient of the LCD panel is changed, sending the corresponding command D1 to the voltage reference circuit will get the reference voltage $V_{fn}$ which can compensate for the temperature effect of the LCD panel and the value of $V_{fn}$ at temperature T is the predetermined value $V_{dd}$.

The series resistors $R_1$~$R_{N+1}$ in the voltage regulation circuit 50 can be fabricated with the same type, for example, the type of polysilicon resistor or the type of well resistor. It turns out that both denominator and numerator of the amplification gain $A_n$ have the same temperature coefficient, which yields a substantially temperature-independent amplification gain $A_n$.

In summary, the embodiment of the present invention in comparison with the prior arts has the following advantages:

The embodiment employs the original micro-controller interface 20 to control the voltage reference circuit, so no extra pin is needed. That is to say, the invention provides the same micro-controller interface for users' convenience;

The embodiment uses the same voltage reference circuit with controllable temperature coefficients for several types of LCD panels in order to simplify manufacture processes and eliminate cost of product;

The embodiment can be directly applied to most LCD panels because the present invention utilizes a common temperature coefficient as the default setting of the voltage reference circuit with controllable temperature coefficients. If an LCD panel has a different temperature coefficient, it will simply change the command D1 to generate a corresponding reference voltage which match the LCD-driving voltage requirement of LCD panel.

Although one embodiment of the invention has been illustrated in the accompanying drawings and described herein, it will be apparent to those skilled in the art to which the invention pertains from the foregoing description that variations and modifications of the described embodiment may be made without departing from the true spirit and scope of the invention. Accordingly, it is intended that the invention shall be limited only to the extent required by the appended claims and the rules and principles of applicable law.

What is claimed is:

1. A voltage reference circuit with controllable temperature coefficients, comprising:

a logic operation unit for receiving a command corresponding to a first temperature coefficient of a liquid crystal display (LCD) panel and providing a selection signal according to the command;

a voltage selection circuit for receiving the selection signal and generating a selected voltage having a second temperature coefficient substantially equal to a ratio of the first temperature coefficient to an amplification gain, in which the selected voltage includes a first DC voltage dependent on the second temperature coefficient; and a voltage regulation circuit having the amplification gain controlled by the logic operation unit, for regulating a second DC voltage from the first DC voltage and generating a reference voltage including the second DC voltage independent of the first temperature coefficient.

2. The voltage reference circuit as claimed in claim 1, wherein the voltage selection circuit comprises:

a voltage circuit having a plurality of output terminals to provide a plurality of selectable voltages; and a first multiplexer for receiving the selection signal and selecting the plurality of selectable voltages to generate the selected voltage.

3. The voltage reference circuit as claimed in claim 1, wherein the voltage regulation circuit comprises:

an operational amplifier having an output terminal, an inverting input terminal and a non-inverting input terminal, wherein the selected voltage is applied to the non-inverting input terminal;

a plurality of resistors connected in series between ground and the output terminal of the operational amplifier, and forming a plurality of connection nodes among the plurality of resistors; and a second multiplexer controlled by the logic operation unit to select one of the plurality of connection nodes coupled to the inverting input terminal of the operational amplifier.

4. The voltage reference circuit as claimed in claim 3, wherein the operational amplifier produces a reference voltage having the second DC voltage which is independent of the temperature coefficient.

5. The voltage reference circuit as claimed in claim 3, wherein the plurality of resistors have the same temperature coefficient.

6. The voltage reference circuit as claimed in claim 5, wherein types of the plurality of resistors are the same.

7. The voltage reference circuit as claimed in claim 6, wherein the type of resistor is polysilicon resistor or well resistor.

* * * * *